US007585256B2

(12) United States Patent
Harbaugh, IV et al.

(10) Patent No.: US 7,585,256 B2
(45) Date of Patent: Sep. 8, 2009

(54) SWIMMING SIMULATION EXERCISE APPARATUS

(76) Inventors: David Day Harbaugh, IV, 367 Cherokee Ave., Superior, CO (US) 80027; Carly Ann Greer, 1909 Denver West Ct., Lakewood, CO (US) 80401; Michael Ryan Wallden, 200 E. Angeleno Ave., Burbank, CA (US) 91502; Charles Scott Whipple, 7620 S. Linke Rd., Greenacres, WA (US) 99016

( * ) Notice: Subject to any disclaimer, the term of this patent is extended or adjusted under 35 U.S.C. 154(b) by 557 days.

(21) Appl. No.: 10/908,850

(22) Filed: May 27, 2005

(65) Prior Publication Data

US 2005/0277523 A1 Dec. 15, 2005

Related U.S. Application Data

(60) Provisional application No. 60/574,868, filed on May 27, 2004.

(51) Int. Cl.
*A63B 69/10* (2006.01)

(52) U.S. Cl. ..... 482/56; 434/254

(58) Field of Classification Search ..... 482/55, 482/56, 121, 122, 126, 127, 140, 142, 148; 441/55; 434/254, 255

See application file for complete search history.

(56) References Cited

U.S. PATENT DOCUMENTS

| | | | | | |
|---|---|---|---|---|---|
| 1,176,365 | A * | 3/1916 | Hartnett | ..... | 482/56 |
| 2,013,520 | A * | 9/1935 | McDermott | ..... | 482/56 |
| 2,332,184 | A * | 10/1943 | Sweeney | ..... | 601/26 |
| 4,830,363 | A * | 5/1989 | Kennedy | ..... | 482/56 |
| 4,844,450 | A * | 7/1989 | Rodgers, Jr. | ..... | 482/56 |
| 5,158,513 | A | 10/1992 | Reeves | ..... | 482/56 |
| 5,366,426 | A * | 11/1994 | Glavin | ..... | 482/56 |
| 5,376,060 | A * | 12/1994 | Murray | ..... | 482/56 |
| 5,429,564 | A | 7/1995 | Doane | ..... | 482/56 |
| 5,540,591 | A | 7/1996 | Doane | ..... | 434/254 |
| 5,628,632 | A | 5/1997 | Doane | ..... | 434/254 |
| 5,860,899 | A * | 1/1999 | Rassman | ..... | 482/142 |
| 6,352,493 | B1 * | 3/2002 | Davis | ..... | 482/56 |
| 6,764,431 | B2 * | 7/2004 | Yoss | ..... | 482/56 |
| 6,790,163 | B1 * | 9/2004 | Van De Laarschot et al. | . | 482/56 |

* cited by examiner

*Primary Examiner*—Loan H Thanh
*Assistant Examiner*—Tam Nguyen
(74) *Attorney, Agent, or Firm*—Holland & Hart LLP

(57) ABSTRACT

A swimming simulation system is provided, aspects of which include a dynamic bench, an arm cable pulley system coupled with hand grips, a foot cable pulley system coupled with a foot hold, and a resistance mechanism with attached gearing systems. All of the assemblies are operatively connected to a support frame. A user may lay face forward on the dynamic bench, or on their back on the dynamic bench, and pull the hand grips and/or foot holds to simulate swimming. The dynamic bench comprises a fixed center portion and independently rotatable sides that are interconnected at an interior edge to the fixed center portion and to biasing members at a point away from the interior edge. The side portions move independently of each other and provide a simulation of the yaw a swimmer experiences while swimming.

10 Claims, 3 Drawing Sheets

SWIMMING SIMULATION EXERCISE APPARATUS

CROSS REFERENCE TO RELATED APPLICATIONS

The present application claims the benefit of U.S. Provisional Patent Application No. 60/574,868, filed on May 27, 2004, entitled "SWIMMING SIMULATION APPARATUS", the entire disclosure of which is incorporated herein by reference.

FIELD OF THE INVENTION

The present invention is directed to an exercise apparatus and, more specifically, to an apparatus for simulating swimming in the absence of water.

BACKGROUND OF THE INVENTION

A healthy lifestyle involves good diet and regular exercise. Poor diet and/or little or no regular exercise can have long term adverse health impacts. For example, a person who has a poor diet and who exercises infrequently (or not at all) may be obese, have high blood pressure, high cholesterol, and in many instances a reduced immune system. For these reasons, many doctors and other health industry experts strongly recommend a lifestyle having both a good diet along with a regular exercise routine. Unfortunately, time constraints and/or fiscal restraints reduce the ability for many people to practice such a healthy lifestyle. Furthermore, an injury or other medical condition may reduce a person's ability to obtain regular exercise.

Swimming is recognized to be one of the most beneficial exercise activities. Swimming is known to be a highly aerobic exercise which works many different muscle groups in both the upper and lower body. Swimming also has little or no impact on joints, unlike many other exercise activities. For example, running is known to cause significant joint damage in many individuals who participate in the sport over the long term. Swimming is many times therefore a very beneficial exercise routine for many people, providing many benefits while consuming relatively little time.

Swimming provides a cardiovascular workout due to the significant amount of activity involved. In many cases, this cardiovascular workout is equivalent or superior to, for example, running or cycling. In addition to the cardiovascular workout, swimming also provides an efficient and significant upper and/or lower body muscle workout. Many different forms of swimming may be practiced to exercise different muscle groups. For example, a crawl stroke provides a workout to arm muscles including the biceps and triceps, chest muscles including pectoral muscles, abdominal muscles, and back muscles including lats. The breast stroke provides a workout to arm muscles including the biceps and triceps, chest muscles including the pectorals, abdominal muscles, and back muscles including the lats. The back stroke provides a workout to similar muscle groups as well.

Many people recognize the positive aspect of swimming, and may desire to integrate swimming into their exercise routine, but choose to use other exercises as their primary aerobic/muscle exercises because of convenience. For example, many people may not have access to a swimming pool, and thus are not able to conveniently participate in a regular swimming exercise routine. Furthermore, certain people may have access to a swimming pool but still not swim because of the requirement to be submersed in water, which may be inconvenient, uncomfortable, and/or impossible. Some people may be restricted from swimming in water for medical reasons, such as, for example, recent surgery. Further, other people may prefer not to swim for more personal reasons, such as a dislike or fear of water, and some people may prefer not to be seen in a bathing suit.

SUMMARY OF THE INVENTION

The present invention provides a swimming simulation exercise apparatus that simulates the many forces a swimmer is subjected to, thus allowing a user to perform an exercise similar to swimming while not requiring the user to be submersed in water. The apparatus provides a resistance to arm and/or leg motions similar to the resistances a swimmer would experience, and also provides a simulation of the buoyancy that a swimmer would experience.

In one embodiment, a simulation exercise apparatus of the present invention comprises (a) a support frame having a first end and a second end; (b) a bench operatively interconnected to the support frame proximate to the first end; (c) an arm cable pulley assembly mounted on the support frame proximate to the second end having a handgrip and a cable interconnected to the handgrip; and (d) a resistance assembly operatively interconnected to the support frame and operatively interconnected to the arm cable pulley assembly. The bench, in an embodiment, has a lower bench portion and an upper bench portion, the upper bench portion distal to the first end. The upper bench portion may comprise an elongate fixed center support and at least first and second wings operably interconnected to the fixed center support on opposite sides thereof. The first and second wings are independently rotatable about said fixed center support.

The resistance assembly, in an embodiment, provides resistance against pulling the cable when a force is applied thereto, and provides a restoring force to retract the cable when substantially no force is applied thereto. The amount of resistance provided by the resistance assembly is variable based on the velocity at which the cable is pulled. The amount of resistance provided by the resistance assembly, in one embodiment, is proportional to the square of the velocity at which the cable is pulled.

The exercise apparatus may further include a foot cable pulley assembly mounted on the support frame proximate to the first end, comprising a foot support and a second cable interconnected to the foot support; and a second resistance assembly operatively interconnected to the support frame and operatively associated with the foot cable pulley assembly. The second resistance assembly provides resistance against pulling the second cable when a force is applied thereto, and provides a restoring force to retract the second cable when substantially no force is applied thereto.

DETAILED DESCRIPTION

Figure 1:
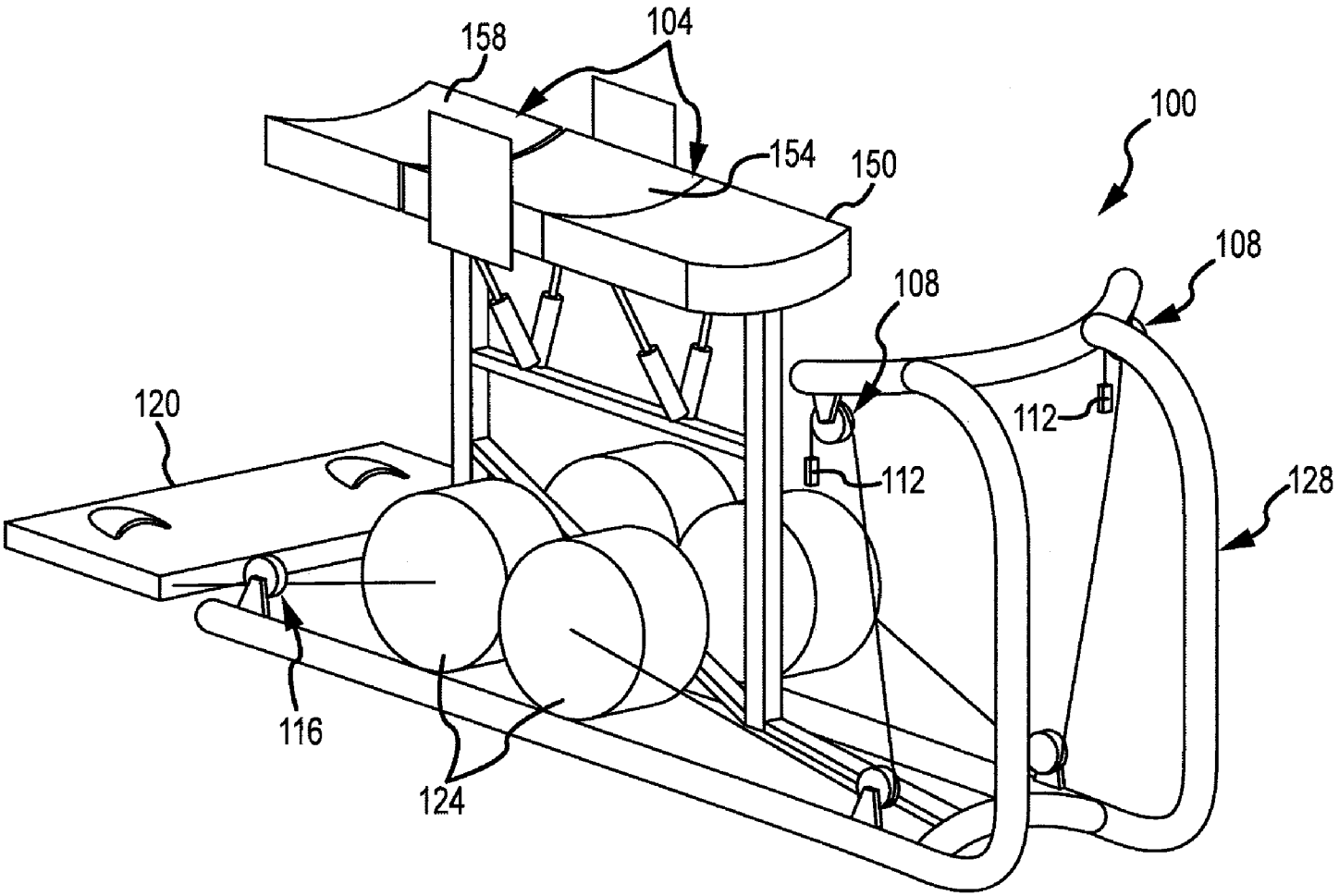
FIG. 1 is a perspective illustration of a swimming trainer according to an embodiment of the invention.

The present invention recognizes that numerous physical forces act on a swimmer in water. For example, gravity acts to pull a body and submerse it, and the relative densities of the body with respect to water determine if the body sinks. For example, a solid steel pellet will sink to the bottom of a pool of water, while an inflated plastic ball will float near the surface of the pool of water. The human body, in general, is a neutrally buoyant body and experiences little net external force. The force of gravity is largely offset by the buoyancy of the human body and, in the absence of any current, little net external force is present on the body. It is also recognized that water is a viscous fluid, and an object moving through water experiences viscous drag. Thus, in order to move in water, a swimmer must generate a mean thrust at least somewhat greater than viscous drag in the direction of desired travel. Due to the complex fluid dynamics of water, a swimmer is moving in a turbulent flow profile where inertial pressure forces normal to the surface of the object dominate the system. The inertial pressure forces arise from the average kinetic energy. Kinetic energy is characterized by:

$$\tfrac{1}{2} mv^2 \qquad \text{(Equation 1)}$$

where m is the mass of the object and v is the velocity.

The force that the swimmer experiences can be related by aerodynamic drag, that is, similar principals as used for designing aircraft. Because of the kinetic energy relationship in a turbulent system, the resistance can be found by evaluating the equation:

$$R=\tfrac{1}{2}C_b pAv^2 \qquad \text{(Equation 2)}$$

where R is resistance force, $C_b$ is a drag coefficient, p is the density of the fluid, A is cross-sectional area, and v is the velocity. A swimmer's body has many moving portions. The torso of a swimmer has a first area and velocity, the swimmer's hands each have associated second and third areas and velocities, and the swimmer's feet each have associated fourth and fifth areas and velocities. Taking a single hand, for example, the area and velocity of the hand are the predominant factors in the amount of force experienced at the hand. Because the area of the hand is largely constant, the changes in force felt by a swimmer result primarily from changes in the hand velocity. Accordingly, the present invention recognizes that in order to have a relatively accurate simulation of swimming, it is beneficial to capitalize on the velocity-squared relationship to the resistance force in order to achieve an accurate force profile on a user's body. In other words, when a user's hand is moving fastest through the water, the most force is being felt. The resistance mechanism of a swimming training machine of this invention emulates this velocity-squared resistance force to provide a realistic swimming simulation.

With respect to a swimmer's torso, the presence of lungs, and thus air, in the torso provides additional buoyancy to this portion of a swimmer's body. When swimming, the torso also feels forces applied by the arms/hands and legs/feet. Many swimming motions result in alternating forces being applied to the sides of the torso. For example, the crawl stroke results in alternating forces being applied on opposite sides of the torso as the swimmer's arms/legs alternatively stroke/kick. These alternating forces result in the swimmer's torso rolling about a longitudinal center axis. Further, because the swimmer's arms and legs may be stroking/kicking at different times, the shoulder portion of the torso may roll about the center axis independently of the hips portion of the torso. Thus, the present invention further recognizes that in order to have a relatively accurate simulation of buoyancy in water, it is beneficial to achieve an accurate force profile on a user's torso. The bench mechanism of a swimming training machine of some embodiments of this invention emulates the roll of a swimmer's torso to provide a realistic swimming simulation.

Having discussed some of the principles of the act of swimming, some embodiments of the present invention are described with reference to the drawing figures. Referring first to FIG. 1, a swimming simulation system 100 of an embodiment of the present invention is illustrated. The system 100 is made of several assemblies, including a dynamic bench 104, an arm cable pulley system 108 coupled with hand grips 112, and a foot cable pulley system 116 coupled with a foot hold 120, and a resistance assembly 124 with attached gearing systems (not shown). All of the assemblies are operatively connected to a support frame 128 which in an embodiment is formed from tubular aluminum, although any material of sufficient size and strength may be used. In this embodiment, users have the option of laying face forward on the dynamic bench 104, or on their back on the dynamic bench 104.

Figure 2:
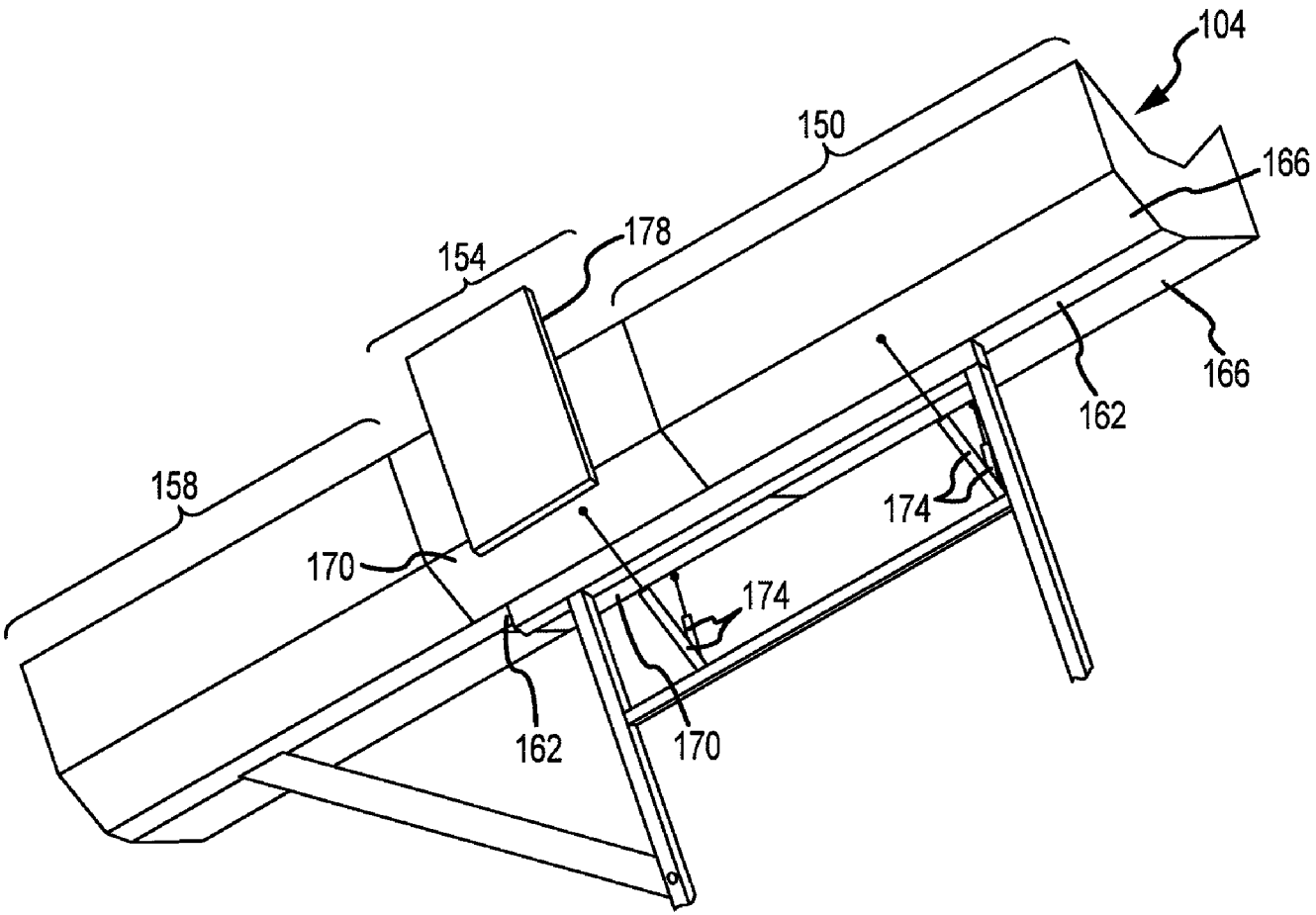
FIG. 2 is a perspective illustration of a bottom portion of a bench and related swimming trainer for an embodiment of the invention.

The dynamic bench 104 in the swimming simulation system 100 is designed to allow a user's torso to roll about a longitudinal center axis. This allows a user to experience the natural roll similar to that felt while swimming, and also helps prevent the user from injuring their shoulder muscles. Referring now to FIG. 2, the assembly of the dynamic bench 104 is now described in additional detail. In this embodiment, the dynamic bench 104 is a three-part bench having a front section 150, a middle section 154, and a back section 158. The back section 158 may be used as leg support or as a seat. The front section 150 of the embodiment of FIG. 2 has a fixed center portion 162, and two independent wings 166 coupled to the fixed center portion 162. In one embodiment, an inside edge of the wings 166 are attached to the fixed center portion 162 by a hinge, although any suitable connection may be used that secures the wings 166 to the fixed center portion 162 and allows the wings 166 to rotate about the point of securement. Similarly, the middle section 154 of the bench 104, in the embodiment of FIG. 2, shares the fixed center portion 162 and has two separate independent wings 170 that are affixed to the fixed center portion 162 in a similar manner as described with respect to wings 166.

The sets of independent wings 166 and 170 are biased in a neutral position by biasing devices 174. Biasing devices, in the embodiment of FIG. 2 are pneumatic pistons that are normally in the extended position and move to a retracted position when a force is applied thereto. However, it will be understood that numerous other types of biasing devices may be used, such as, for example, springs, hydraulic pistons, rubberized material, and electrical/magnetic systems, to name a few. The biasing devices 174 are attached to the independent wings 166, 170 at a location away from the fixed center portion 162, and in the embodiment of FIG. 2, are affixed at about the midpoint between the inner edge of each wing 166, 170 and an outer edge of the wings 166, 170. In this manner, the biasing devices 174 bias each of the wings 166, 170 in an upper, or neutral, position and allow the outside edge of a wing 166, 170 to move to a lower position when sufficient force is applied to the wing 166, 170. Such a force, for example, may come from a user of the apparatus pulling on a handgrip of the apparatus and performing a swimming type of movement with one arm. The user's arm, when moving below the plane of the bench 104 exerts an upward force on that side of the user's body and a resultant downward force on the opposite side of the user's body. This downward force on the opposite side of the user's body may apply sufficient force to the respective wing 166 to overcome the biasing force of the biasing device 174 associated with that wing 166, resulting in the outer edge of the wing 166 moving downward.

As each of the wings 166, 170 are independently attached to the fixed center portion 162, and each of the wings 166, 170 has an associated biasing device 174, the bench 104 permits rotation in four independent rotating sections. The wings 170 associated with the middle section 154 of the bench 104 rotate independently of the wings 166 of the front section 150 of the bench 104. The middle section 154 allows rotation for a user's hips, and the front section 150 permits rotation for a user's shoulders. In another embodiment, the front and middle sections of the bench 150, 154 may be raised or lowered together by moving an inclination support member (not shown) under the bench up and down an inclined path. In such an embodiment, one or more members of the support frame may telescope, or otherwise be extendable, to provide proper support for all inclinations of the bench, the design of such members being well within the abilities of one skilled in the art. By changing the inclination of the bench 104, the user may find the position where they are ultimately the most comfortable while using the machine. In the embodiment of FIG. 2, there is also an optional third section 158 of the bench located at the back of the system. This section is static and does not rotate or incline, and can be used as extra leg support or as a seat when the other two sections of the bench are inclined. It may also be retracted if a user chooses not to use it.

The dynamic bench 104 may also include a head rest (not shown) which provides additional support to a user's head while using the system. The shape of the bench 104 is generally concave and its surface has a high friction coefficient to enhance safety while reducing the likelihood that a user will slide from the bench 104. In the embodiment illustrated in FIGS. 1 and 2, hip supports 178 are also affixed to the middle section 154 to further help secure the user on the bench 104. In this embodiment, hip supports 178 are affixed to each of the wings 170, but may also be mounted on the support frame. If the hip supports 178 are affixed to the wings 170, the hip supports 178 will also rotate about the fixed center axis 162 when sufficient force is applied to overcome the upward bias of the biasing device 174. Alternatively, if such hip supports 178 are mounted to the support frame, the wings 170 of the middle section 154 will rotate about the fixed center axis 162 independently of the hip supports 178. The bench 104 also includes, in an embodiment, a viscoelastic memory foam covering the upper surface of the bench 104, thus providing additional comfort to a user when using the system. While the dynamic bench 104 illustrated in the drawing figures has two sets of independent wings, it will be understood that such a bench may have more or fewer sets of independent wings. Furthermore, the amount of force required to overcome the force applied by one or more of the biasing devices may be selectable, based on the requirements of the user.

Figure 3:
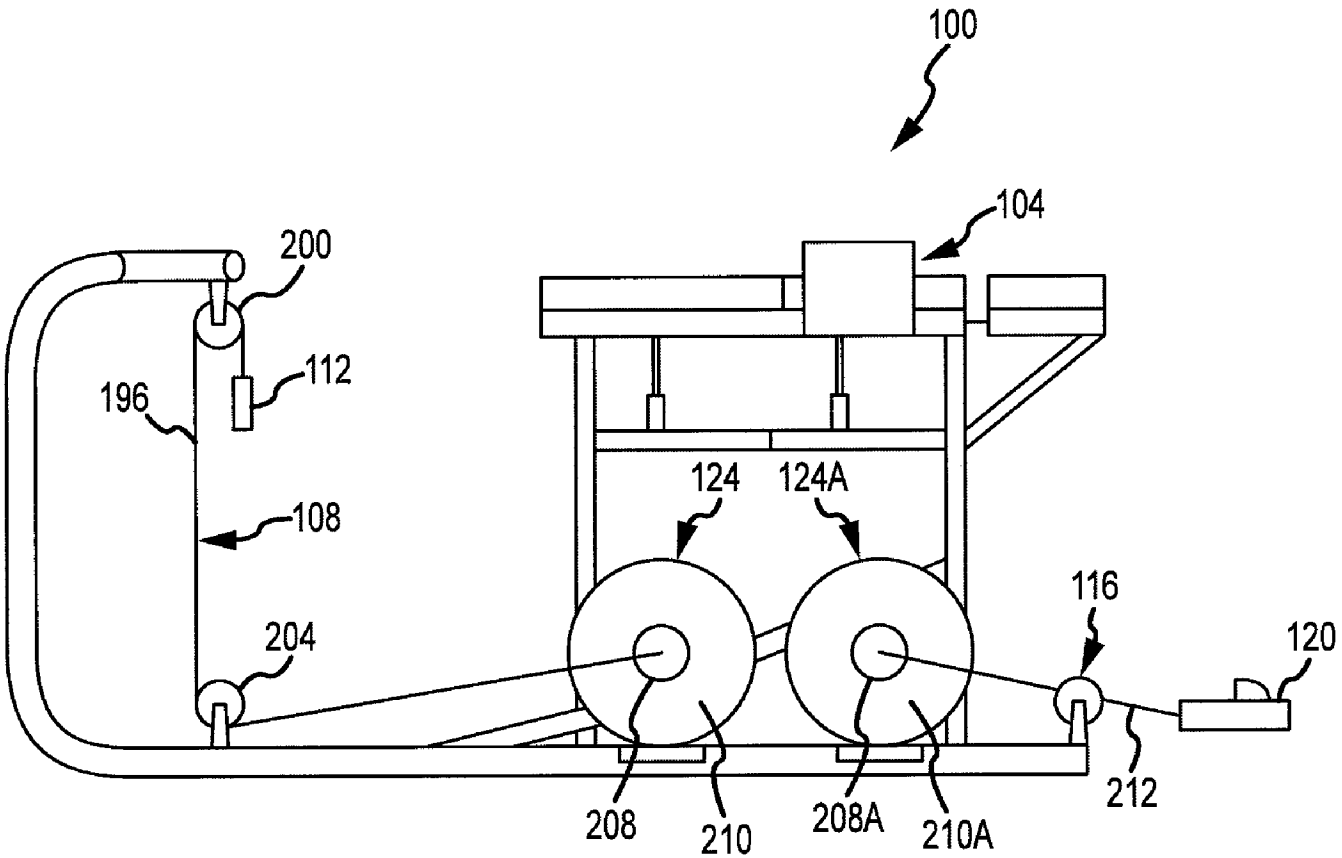
FIG. 3 is a side elevation view of a swimming trainer of an embodiment of the invention.

The pulley systems of an embodiment of the invention are illustrated in FIG. 3. The arm cable pulley system 108 includes a cable 196 which connects hand grip 112 through a first pulley 200 and a second pulley 204 to the resistance assembly 124. A spooling mechanism 208 is associated with the resistance assembly 124, and the spools and cable 196. From the spooling mechanism 208, the cable 196 is threaded through the second pulley 204. The cable 196 is then pulled to the top of the frame and threaded through the first pulley 200. At this point, the cable 196 is attached to hand grip 112, which the user may then pull when using the system. The top attachment point that attaches the pulleys to the frame may also be adjustable to provide a different height of the top pulleys 200. In this manner, the height of the top pulleys 200 may be adjusted as appropriate for the particular user and for any inclination of the bench 104. As a user pulls on the hand grip 112, tension is created in the cable 196 resulting in the spooling mechanism 208 releasing cable 196 so that the user may start their stroke. Resistance is provided by the resistance assembly 124 as the cable 196 is pulled from the spooling mechanism 208.

A monodirectional clutch is engaged to couple the spooling mechanism 208 to a resistance device 210. Furthermore, as mentioned above, the resistance assembly 124, in an embodiment, provides resistance to the cable 196 as is it being pulled, with the magnitude of the resistance depending upon the velocity at which the cable 196 is being pulled. In one embodiment, the resistance is proportional to the square of the velocity at which the cable 196 is pulled. Accordingly, as a user pulls the cable 196 faster, the resistance provided to the cable 196 is increased. When the user is on the recovery phase of the stroke, i.e., they are no longer pulling, a constant force spring within the spooling mechanism 208 retracts the cable 196. When the user releases the tension from the cable 196, the monodirectional clutch disengages the resistance device 210 from the spooling mechanism 208, and the constant force spring provides a retracting force to re-spool the cable 196 onto the spooling mechanism 208. In one embodiment, the constant force spring retracts the cable 196 with about five pounds of force. However, the amount of force is merely that force which would be required to retract the cable 196, and may be different than five pounds of force.

The spooling mechanism 208 may also have different gearing to couple the resistance device 210 with the spooling mechanism 208. In this manner, the resistance provided by the resistance device and spooling mechanism may be selected to provide relatively high resistance, relatively low resistance, or a range of resistances, depending upon the gear ratio selected. Such gearing may be accomplished, for example, by having different diameter gears that are available to couple the resistance device 210 to the spooling mechanism 128. A particular gear may then be selected based on the amount of resistance desired. For example, if a user is a relatively strong swimmer, the user may desire that increased resistance be provided during the swimming strokes. A high gear ratio coupling the resistance device 210 and spooling mechanism 208 may be selected. The amount of force required to pull the cable 196 from the spooling mechanism 208 is thus increased relative to the amount of force required to pull the cable 196 if a lower gear ratio was selected. The resistance provided by the resistance assembly 124 continues to be variable depending upon the velocity at which the cable 196 is pulled as described above. Likewise, if a user desires to have a relatively low resistance provided by the resistance assembly 124, a low gear ratio may be selected. The spooling mechanism and gearing associated therewith will be described in more detail below.

The foot design is such that a foot cable 212 traverses from a rear resistance assembly 124A through the foot cable pulley system 116 to the foot support 120. The rear resistance assembly 124A is substantially similar to the resistance assembly 124 as described above with respect to the arm cable pulley system 108. The rear resistance assembly 124A contains a spooling mechanism 208A, which spools cable 212. Initially, a user positions the foot support 120 onto the user's feet by pulling the foot support 120 into position such that their feet may be inserted when the user is lying on the bench 104. As a user pulls on the foot support 120, tension is created in the cable 212 resulting in the spooling mechanism 208A releasing cable 212 so that a user may start their stroke. The spooling mechanism 208A is coupled to resistance device 210A as described with respect to the arm resistance assembly 124. When the user is on the recovery phase of the stroke, i.e., they are no longer pulling; a constant force spring within the spooling mechanism 208A retracts the cable 212. In one embodiment, similarly described above, the constant force spring retracts the cable with about five pounds of force. In this embodiment, the resistance assembly 124A provides resistance to the foot cable 212 and foot support 120 when a user is pulling upward on the foot support 120. However, in other embodiments additional pulleys may be included in the foot cable pulley system 116 in order to provide resistance when a user is pulling downward on the foot support 120. In another embodiment, the user's feet are connected to an elastic device which replaces the rear resistance assembly 124A and provides resistance in all directions.

The spooling mechanisms 208, 208A are largely identical, and will be described with reference to spooling mechanism 208 only with the understanding that other spooling mechanisms for other portions of the system 100 operate in a similar fashion. As mentioned above, the spooling mechanism for the cable is attached to the shaft by a one-way, or monodirectional, clutch. The one-way clutch provides resistance when a torque is applied in a first direction and provides little or no resistance when torque is applied in a second direction. The spooling device is separated by two sections. The first section holds and spools the cable. The second section features a substantially smaller diameter than the first section and attaches the cable or constant force spring that provides a restoring/recoil force. The second section is designed with this smaller diameter in order to minimize the lever arm and overall torque produced by the recoil device. The spooling mechanism 208 includes a gearing system that transfers resistance from the resistance mechanism 124 to the user. The spooling mechanism 208 includes a shaft connected to the resistance mechanism 124, so that when the cable 196 is pulled, the resistance mechanism 124 is engaged, creating tension in the cable 196 and resistance as felt by a user pulling hand grip 112. Force transferred to the cable 196 is accomplished by the mono-directional clutch with mild restoring force attached to the cable spool. The restoring force, as mentioned, may be provided by a constant force spring. Force transferred to the user's arms and legs is accomplished through the cable pulley systems 108, 116. Resistance may be adjusted by the gearing system that varies the gearing ratio, and hence the force output transferred to the user. In an embodiment, the resistance mechanism is an air resistance mechanism, although other types of resistance mechanisms may be utilized. In another embodiment, the resistance mechanism is an air resistance mechanism that provides a resistance that is proportional to the square of the velocity at which the cable is being pulled.

While described with reference to a swimming exercise simulation, the apparatus of the present invention may serve a multitude of user directed functions other than swimming simulation. In an inclined position, a user sitting on the bench may perform, for example, an incline press, flies, or a swim stroke in a sitting position. An optional seat that moves on a monorail, or is static, may be included in front of the bench near the pulley system. A user may sit in the seat and perform, for example, lat pull-downs, bench press, rowing exercises, and other exercise that isolate the biceps and triceps. As will be understood, these are just a few examples of the uses of the system. Other applications for fitness and/or rehabilitation are possible as will be readily observable by one of skill in the art. Furthermore, as an alternative to the optional seat in front of the bench near the front pulley system, a wheelchair could be moved into this position.

The foregoing discussion of the invention has been presented for purposes of illustration and description. Further, the description is not intended to limit the invention to the form disclosed herein. Consequently, variations and modifications commensurate with the above teaching within the skill and knowledge of the relevant art are within the scope of the present invention. The embodiment described herein above are further intended to explain the best modes presently known of practicing the inventions and to enable others skilled in the art to utilize the invention in such or other embodiments, and with the various modifications required by their particular application or uses of the invention. It is intended that the appended claims be construed to include alternative embodiments to the extent permitted by the prior art.

What is claimed is:

1. An exercise apparatus, comprising:

a support frame having a first end and a second end;

a dynamic bench operatively interconnected to said support frame proximate to said first end, having a lower bench portion and an upper bench portion, said upper bench portion comprising an elongate fixed center portion and first and second independently rotatable side portions interconnected to said fixed center portion on opposite sides thereof, wherein each of said first and second independently rotatable side portions are generally rectangular and have an interior edge and an exterior edge relative to said fixed center portion, and wherein each of said side portions is rotatably connected to said fixed center portion along said interior edge and supported by a biasing member having one end supported on the support frame and an opposite end coupled to a location on the side portion away from said interior edge toward said exterior edge;

an arm cable pulley assembly mounted on said support frame proximate to said second end having a handgrip and a cable interconnected to said handgrip; and a resistance assembly operatively interconnected to said support frame and operatively interconnected to said arm cable pulley assembly, said resistance assembly providing resistance against pulling said cable when a force is applied thereto, and providing a restoring force to retract said cable when substantially no force is applied thereto, wherein the amount of resistance provided by said resistance assembly is variable based on the velocity at which said cable is pulled.

2. The exercise apparatus, as claimed in claim 1, wherein the amount of resistance provided by said resistance assembly is proportional to the square of the velocity at which the cable is pulled.

3. The exercise apparatus, as claimed in claim 1, further comprising:

a foot cable pulley assembly mounted on said support frame proximate to said first end, comprising a foot support and a second cable interconnected to said foot support; and a second resistance assembly operatively interconnected to said support frame and operatively associated with said foot cable pulley assembly, said second resistance assembly providing resistance against pulling said second cable when a force is applied thereto, and providing a restoring force to retract said second cable when substantially no force is applied thereto.

4. The exercise apparatus, as claimed in claim 1, wherein each of said biasing members is operably interconnected to respective side portions at a first end thereof, and are operably interconnected to said support frame at a second end thereof, and wherein said biasing members are operable to bias said side portions in a first position, and when a force is applied to a respective side portion allow said exterior edge to move to a second position.

5. The exercise apparatus, as claimed in claim 4, wherein said bench further comprises:

third and fourth independently rotatable side portions interconnected to said elongate fixed center portion on opposite sides thereof; and biasing members operatively interconnected to said third and fourth rotatable side portions at a first end thereof, and are operably interconnected to said support frame at a second end thereof, and wherein said biasing members are operable to bias said third and fourth side portions in a first position, and when a force is applied to a respective side portion allow an exterior edge of the respective side portion to move to a second position.

6. An exercise apparatus, comprising:

a support frame having a first end and a second end;

a bench operatively interconnected to said support frame proximate to said first end, having a lower bench portion and an upper bench portion, said upper bench portion distal to said first end and comprising an elongate fixed center support and at least first and second wings operably interconnected to said fixed center support on opposite sides thereof, said first and second wings are independently rotatable about said fixed center support and said first and second wings are generally rectangular, each wing having an interior edge and an exterior edge relative to said fixed center support and each wing being rotatably connected to said fixed center support along said interior edge and each wing being supported by a biasing member having one end supported on the support frame and an opposite end coupled to a location on the wing away from said interior edge toward said exterior edge;

an arm cable pulley assembly mounted on said support frame proximate to said second end having a handgrip and a cable interconnected to said handgrip;

a resistance assembly operatively interconnected to said support frame and operatively interconnected to said arm cable pulley assembly, said resistance assembly providing resistance against pulling said cable when a force is applied thereto, and providing a restoring force to retract said cable when substantially no force is applied thereto;

a foot cable pulley assembly mounted on said support frame proximate to said first end, comprising a foot support and a second cable interconnected to said foot support; and a second resistance assembly operatively interconnected to said support frame and operatively associated with said foot cable pulley assembly, said second resistance assembly providing resistance against pulling said second cable when a force is applied thereto, and providing a restoring force to retract said second cable when substantially no force is applied thereto.

7. The exercise apparatus, as claimed in claim 6, wherein the amount of resistance provided by said resistance assembly is variable based on the velocity at which said cable is pulled.

8. The exercise apparatus, as claimed in claim 7, wherein the amount of resistance provided by said resistance assembly is proportional to the square of the velocity at which the cable is pulled.

9. An swimming simulation exercise apparatus, comprising:

a support frame having a first end and a second end;

a bench operatively interconnected to said support frame proximate to said first end, having a lower bench portion and an upper bench portion, said upper bench portion distal to said first end and comprising an elongate fixed center support and at least first and second wings operably interconnected to said fixed center support on opposite sides thereof, said first and second wings are independently rotatable about said fixed center support and said first and second wings are generally rectangular, each wing having an interior edge and an exterior edge relative to said fixed center support and each wing being rotatably connected to said fixed center support along said interior edge and each wing being supported by a biasing member having one end supported on the support frame and an opposite end coupled to a location on the wing away from said interior edge toward said exterior edge;

an arm cable pulley assembly mounted on said support frame proximate to said second end having a handgrip and a cable interconnected to said handgrip;

a resistance assembly operatively interconnected to said support frame and operatively interconnected to said arm cable pulley assembly, said resistance assembly providing resistance against pulling said cable when a force is applied thereto, and providing a restoring force to retract said cable when substantially no force is applied thereto, wherein the amount of resistance provided by said resistance assembly is variable based on the velocity at which said cable is pulled;

a foot cable pulley assembly mounted on said support frame proximate to said first end, comprising a foot support and a second cable interconnected to said foot support; and a second resistance assembly operatively interconnected to said support frame and operatively associated with said foot cable pulley assembly, said second resistance assembly providing resistance against pulling said second cable when a force is applied thereto, and providing a restoring force to retract said second cable when substantially no force is applied thereto.

10. The exercise apparatus, as claimed in claim 9, wherein the amount of resistance provided by said resistance assembly is proportional to the square of the velocity at which the cable is pulled.

* * * * *